US006604699B1

(12) United States Patent
Polinski et al.

(10) Patent No.: US 6,604,699 B1
(45) Date of Patent: Aug. 12, 2003

(54) METHOD FOR SECURING A GYRATORY CRUSHER MANTLE

(75) Inventors: Donald J. Polinski, Neenah, WI (US); Thomas E. Vogltanz, Green Bay, WI (US)

(73) Assignee: Metso Minerals Industries, Inc., Milwaukee, WI (US)

( * ) Notice: Subject to any disclaimer, the term of this patent is extended or adjusted under 35 U.S.C. 154(b) by 217 days.

(21) Appl. No.: 09/928,123

(22) Filed: Aug. 10, 2001

Related U.S. Application Data

(62) Division of application No. 09/451,531, filed on Dec. 1, 1999, now Pat. No. 6,299,083.

(60) Provisional application No. 60/136,899, filed on Jun. 1, 1999.

(51) Int. Cl.[7] ..... B02C 2/04

(52) U.S. Cl. ..... 241/30; 241/24.31; 241/209; 241/215

(58) Field of Search ..... 241/207, 209, 241/215, 24.31, 30

(56) References Cited

U.S. PATENT DOCUMENTS

| | | | | |
|---|---|---|---|---|
| 2,670,142 | A | 2/1954 | Gruender | 241/208 |
| 2,883,218 | A | 4/1959 | Roubal | 287/52.01 |
| 3,076,612 | A | 2/1963 | Motz | 241/295 |
| 3,750,967 | A | 8/1973 | DeDiemar et al. | 241/207 |
| 3,850,376 | A | 11/1974 | Mertz | 241/207 |
| 4,065,064 | A | 12/1977 | Anthony | 241/299 |
| 4,245,791 | A | 1/1981 | Ivanov et al. | 241/207 |
| 4,410,143 | A | 10/1983 | Polinski | 241/209 |
| 4,467,971 | A | 8/1984 | Schuman | 241/215 |
| 4,477,031 | A | 10/1984 | Alford | 241/211 |
| 4,681,269 | A | 7/1987 | Arakawa | 241/101.2 |
| 4,886,218 | A | 12/1989 | Bradley et al. | 241/294 |
| 4,895,311 | A | 1/1990 | Arakawa | 241/207 |
| 5,080,294 | A | 1/1992 | Dean | 241/294 |
| 5,184,389 | A | 2/1993 | Dean | 29/467 |
| 5,850,978 | A | 12/1998 | Jacobson | 241/215 |
| 5,996,916 | A | 12/1999 | Musil | 241/215 |
| 6,063,129 | A | 5/2000 | Dadd et al. | 241/207 |
| 6,065,698 | A | 5/2000 | Karra | 241/207 |
| 6,129,297 | A | 10/2000 | Sawant et al. | 241/101.3 |

*Primary Examiner*—William Hong
(74) *Attorney, Agent, or Firm*—Kinney & Lange, P.A.

(57) ABSTRACT

The head nut assembly for gyratory crusher which includes a shaft having a lower portion, a tapered middle portion and a threaded upper portion. The threaded upper portion extends above the tapered portion. A mantle encompasses the middle tapered portion and has a correspondingly tapered internal side. The internal side is in generally continuous supportive engagement with the shaft middle portion. The mantle additionally has an upper side. A head nut is threadably secured to the upper portion of the shaft. The head nut has a lower face, where at least one bore extends upwardly into the lower face. An annular ring is disposed around the shaft between the mantle and the head nut. The ring has a lower surface coupled with the upper side of the mantle so as to prevent relative rotational movement between the mantle and the ring. An upper surface on the ring is contiguous with the lower face of the head nut. At least one key is disposed between the head nut and the annular ring. The key is completely captured inside the head nut bore and acts to couple the ring to the head nut and prevent relative rotational movement between the ring and the head nut.

7 Claims, 8 Drawing Sheets

18

METHOD FOR SECURING A GYRATORY CRUSHER MANTLE

CROSS-REFERENCE TO RELATED APPLICATION(S)

This application is a divisional of U.S. patent application Ser. No. 09/451,531 filed on Dec. 1, 1999 now U.S. Pat. No. 6,299,083 and claims priority from U.S. Provisional Application Serial No. 60/136,899 filed on Jun. 1, 1999 both of which are incorporated by reference in their entirety herein.

BACKGROUND OF THE INVENTION

Gyratory type crushers are used in the mining industry for reducing ore to a predetermined size for further processing. These style of crushers have taken over most large hard-ore and mineral-crushing applications which has made them an integral part of the mining industry. Typically, a gyratory crusher comprises a stationary conical bowl (or mortar) which opens upwardly and has an annular opening in its top to receive feed material. A conical pestle, opening downwardly, is disposed within the center of the bowl. The pestle is eccentrically oscillated for gyratory crushing movement with respect to the bowl. The conical angles of the pestle and bowl are such that the width of the passage decreases towards the bottom of the working faces and may be adjusted to define the smallest diameter of product ore. The oscillatory motion causes impact with the pestle and bowl, as a piece of ore is caught between the working faces of the bowl and pestle. Furthermore, each bowl and pestle includes a liner assembly replaceably mounted on the working faces, these liners define the actual crushing surface.

The pestle is formed by the liner, called a mantle fitted around the outside of a main shaft. The mantle provides a replaceable wearing surface. A threaded section on the shaft (or a threaded sleeve fit over the shaft) above the tapered portion of the shaft is provided for receiving a head nut. The head nut forces the mantle downward onto the tapered portion of the shaft, and is forceably tightened against the top of the mantle. Tightening prevents relative rotational movement between the head nut and the mantle. When the crusher is put into operation, the large forces involved in crushing stone cause a differential rotational movement between the shaft and the mantle. The head nut on the threaded section of the shaft is also caused to rotate relative to the shaft, in a direction which acts to further tighten the head nut onto the mantle. Thus, the rotational movement of the head nut relative to the shaft causes a large force to be transmitted in a downward direction from the head nut so as to forceably wedge the mantle onto the tapered portion of the shaft, securing the mantle to the shaft. The force also causes the bottom surface of the head nut to be pressed tightly against the top surface of the mantle such that the frictional force between the head nut and the mantle is quite large.

The frictional force between the head nut and the mantle makes it difficult to loosen the head nut by turning. Additionally, during operation of the crusher the crushing surface of the mantle is subjected to a hammering action by repeated impact of the rock or other material being crushed. This hammering action causes the working surface of the mantle to expand by cold working. The expansion of the mantle works to increase the fictional force between the head nut and the mantle. The cumulative effect of the tremendous frictional force between the head nut and the mantle is that it becomes impossible to loosen the head nut by turning it.

It is, however, necessary to remove the head nut when the mantles become worn and need replacing. Since it is not practical to loosen the head nut by turning, it must be cut from the threaded section of the shaft (as with a cutting torch). Removing the head nut in this manner damages the head nut beyond repair so that it cannot be used again. The threaded section of the shaft (or sleeve) is also easily damaged when removing the head nut in this fashion, such that the threaded shaft must be repaired, or possibly replaced. Thus, the cost associated with removing the head nut to replace worn mantles becomes excessive.

A solution to this problem proposed in prior art is to provide a burning ring between the mantle and the head nut. The burning ring is adapted so as to engage to the upper surface of the mantle and the lower surface of the head nut. When the mantle is being replaced, the burning ring is cut with a cutting torch, relieving the frictional forces bearing on the head nut. The threaded portion of the head nut may then easily be unscrewed from the shaft and the mantle can be removed.

The main method taught in prior art of affixing the burning ring to the head nut as well as the burning ring to the mantle is using keying systems. Keys are placed between the surfaces of the head nut and burning ring and between the head nut and the mantle. Typically, the keys are inserted between the components of the head nut assembly (head nut, burning ring, top of mantle) after the components are mounted on the main shaft. A common method is to form a semicircular slot running radially on each of the interfacing component surfaces, align the slots, and then place a circular pin into the slots so as to couple the surfaces together. Other shapes of slots or grooves are also used in conjunction with a key or bolt inserted after the slotted surfaces are aligned. With this arrangement, the key must be welded to the interfacing components in order for the key to be held in place. Only small welds are possible, since large welds would be on or near the exposed crushing surfaces. If the welds are on the crushing surface they are subject to breaking, allowing the key to come loose.

Other methods of attachments utilize the key as the "cutting piece." The "cutting piece" is cut by the operator to separate the components. All of these methods require that the key be exposed to the interior of the crusher. Using exposed keys to connect the head nut, burning ring and mantle is problematic, since the interior of the crusher is a harsh environment which very often results in the keys being knocked out from between the components, uncoupling the components.

If the interface between the head nut and the burning ring or the interface between the burning ring and the mantle become uncoupled, the self-tightening feature of the head nut is lost, since the mantle no longer transfers the twisting force (which occurs when being impacted by rock) to the head nut. The mantle can loosen from the main shaft. If the gyratory crusher is not shut off, the free spinning mantle can cause extensive damage to the crusher. The mantle may crack or break, requiring replacement, or the mantle may twist with respect to the shaft, and gouge the shaft. Alternatively, the mantle may move vertically along the shaft, causing damage to the head nut or the threads of the head nut. All of these can result in extensive repairs at a great cost and with long machine downtime. At the very least, the separation of the assembly components make it necessary to turn off the machine, remove the crushing material and replace the connection, which requires a good deal of labor and lost time.

Additionally, installation problems arise when the components must be aligned after they are mounted to the shaft of the crusher to accommodate a key. The problems occur because the head nut assembly must be tightened to prevent excess "play" between the components. The key cannot be placed between the faces of the components when too much space exists between the components. When the head nut is torqued to the proper level, the slots in the component faces may not line up to accommodate the key. The operator must then untorque the head nut, realign the components, and re-torque the head nut until the correct alignment is attained.

An alternative connecting method depicted in prior art shows the coupling of the head nut to the burning ring by welding. Although welding forms a tight bond between the components and eliminates alignment problems, distortion of the head nut can result. Distortion is caused by the heat required to weld the head nut to secure the head nut to the burning ring and also to plasma torch cut the welds to free the head nut from the burning ring. Distortion of the head nut prevents the head nut from easily being removed from the shaft, and reused. Instead, the head nut must be cut off and replaced, eliminating any advantage gained by using the burning ring in conjunction with the head nut.

BRIEF SUMMARY OF THE INVENTION

The invention is a method for securing a mantle to a shaft. The mantle has a tapered internal side and an upper side and the shaft has a lower portion and a middle portion correspondingly tapered to be in general contiguous supportive engagement with the mantle internal side and additionally has a threaded upper portion extending above the mantle. An annular ring is disposed around the shaft above the mantle. A head nut is threaded to the upper portion of the shaft above the annular ring. The head nut is secured to the ring using a key totally captured inside the head nut in the annular ring.

DETAILED DESCRIPTION

Figure 1:
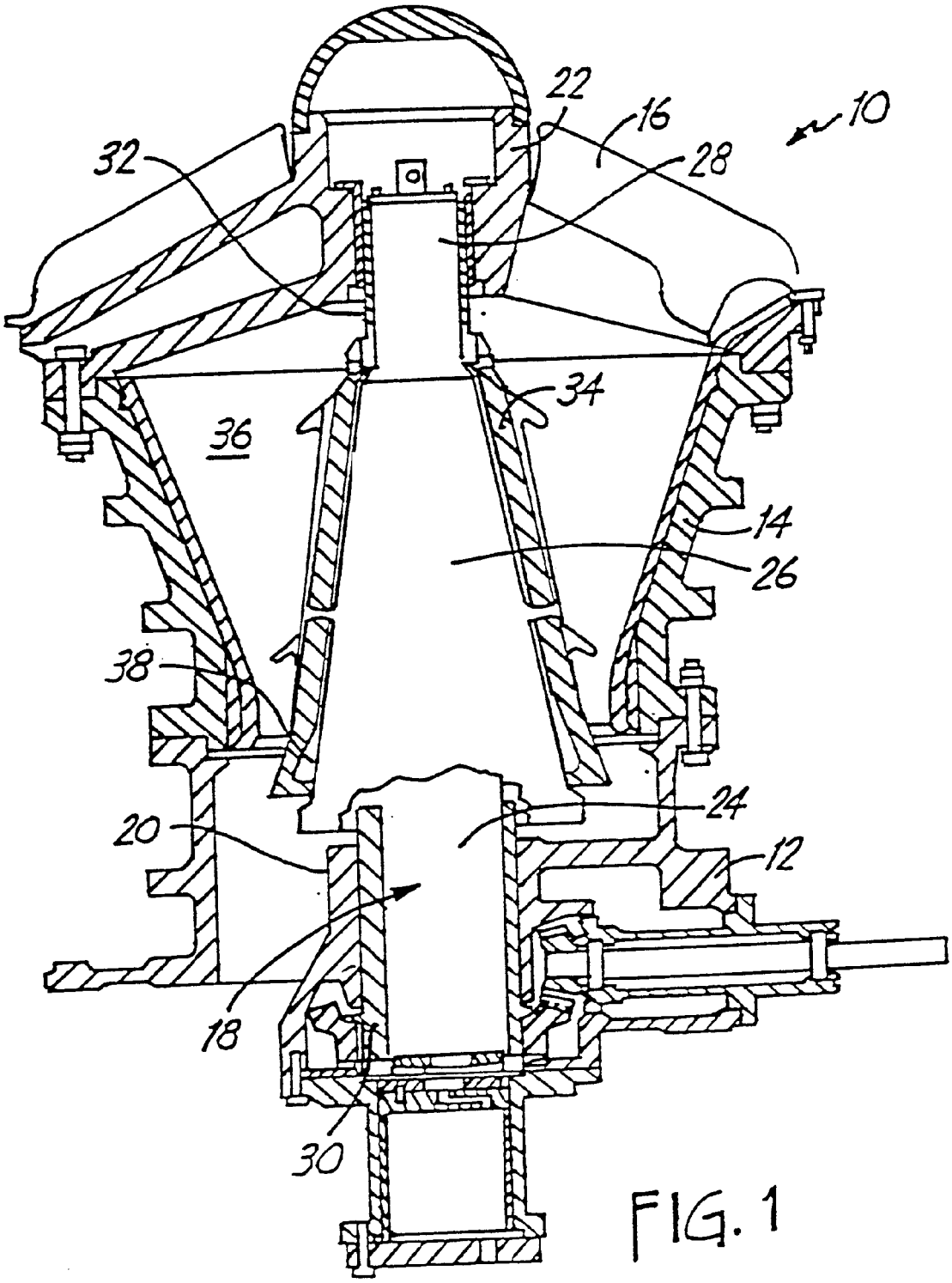
FIG. 1 shows a vertical cross-sectional view of the preferred embodiment of a gyratory crusher equipped with the crusher shaft and inventive head nut assembly.

A gyratory crusher embodying the invention is shown generally at 10 in FIG. 1. The gyratory crusher includes a lower frame 12, an upper frame 14, a top frame 16, and a main shaft 18. The lower frame 12 is provided with a bottom hub 20 opening upwards, and the upper frame 14 is provided with a top hub 22 opening downwards.

The shaft 18 includes a lower journal portion 24, a middle tapered portion 26 extending from the lower journal portion 24 and an upper journal portion 28 converging from the middle tapered portion 26. An eccentric sleeve bearing 30 is fitted about the lower journal portion 24. The lower journal portion 24 and the eccentric sleeve bearing 30 are disposed within the bottom hub 20 so as to be rotatable within the bottom hub 20. A bearing sleeve 32 is fitted about the upper journal portion 28. The bearing sleeve 32 and the upper journal portion 28 are disposed in the top hub 22 so as to be rotatable within the top hub 22. When the eccentric 30 is rotated the shaft 18 is moved transversely with respect to its axis. Thus, the eccentric sleeve bearing 30 causes the shaft to "gyrate" or move eccentrically. Since the eccentric 30 is located in the bottom hub 20, and the shaft 18 is locked in the top hub 22, the travel distance of the shaft 18 decreases from the end of the shaft 18 in the bottom hub 20 to the end of the shaft 18 disposed in the top hub 22. Additionally, the oscillating motion of the shaft 18 within the gyratory crusher causes the shaft 18 to slowly rotate.

A mantle 34 is disposed around the outside of the tapered portion 26 of the shaft 18. The mantle 34 substantially conforms to the shape of the taper and is typically manufactured of manganese steel, although a person skilled in the art would realize that other metals may be used, including other alloy steels. The upper frame 14 surrounds the shaft 18 and mantle 34, forming a crushing chamber 36 disposed substantially between the upper frame 14 and the mantle 34. To operate the crusher, the crushing chamber 36 is filled with rock (or other material) through the top frame 16. The shaft 18 is oscillated eccentrically. The eccentric motion of the shaft 18 causes the rock to be compressed between the walls of the crushing chamber (including the mantle 34 and the upper frame 14), as well as against other rock in the crushing chamber 36. The tapered shape of the mantle 34, the inward sloping walls of the upper frame 14 as well as the increasing transverse movement of the shaft 18 towards the lower end of the shaft causes the area of the crushing chamber 36 to decrease as the rock falls towards the bottom of the chamber 36. Thus, the rock is broken into smaller and smaller pieces until it is removed from the bottom of the crusher. The mantle 34 is cold worked by the impinging rock in the crushing chamber 36, causing the mantle 34 to expand. The mantle 34 also experiences rotational forces (caused by the crushing material as it is compressed against the mantle 34 during the crushing process) counter to the rotational direction of the shaft 18.

Figure 2:
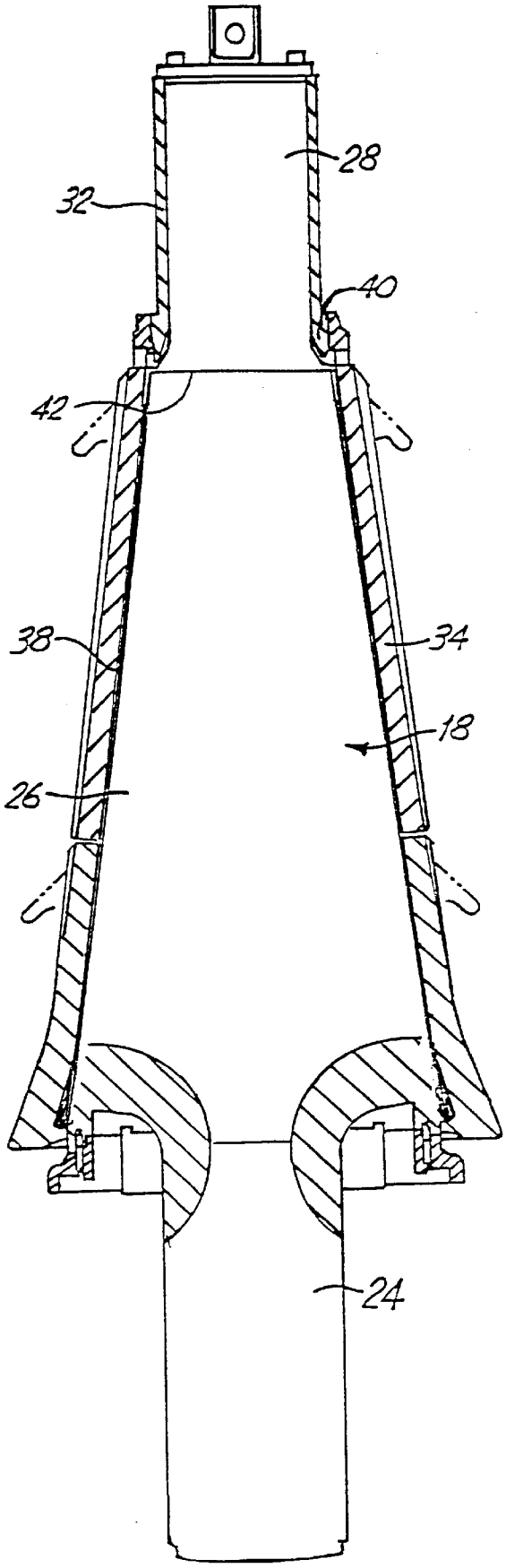
FIG. 2 shows a vertical cross-sectional view of the crusher shaft of the gyratory crusher shown in FIG. 1 utilizing the inventive head nut assembly.

To support the mantle 34 on the main shaft 18, a filler or backing material 38 (known to those skilled in the art, such as using a zincing process) is poured between the shaft 18 and the mantle 34 as shown in FIG. 2. The filler material 38 is allowed to cool and solidify and thereby maintains a contiguous connection between the shaft 18 and the mantle 34. The material 38 adheres to the inside of the mantle 34, however, it does not adhere to the main shaft 18. The filler 38 is used to provide a tight clearance between the mantle 34 and the shaft 18, helping to secure the two pieces together. The main securing mechanism, however, is provided by connecting the upper journal portion 28 of the shaft 18 to the mantle 34.

Figure 3:
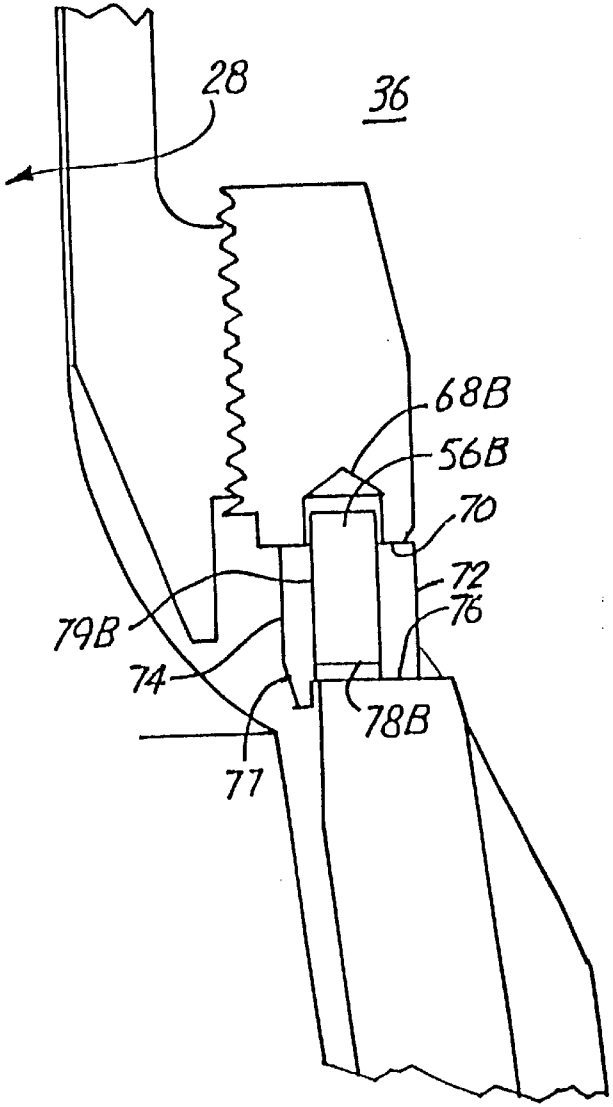
FIG. 3 shows a partial cross-sectional view of the crusher shaft and inventive head nut assembly shown in FIG. 2.
Figure 3:
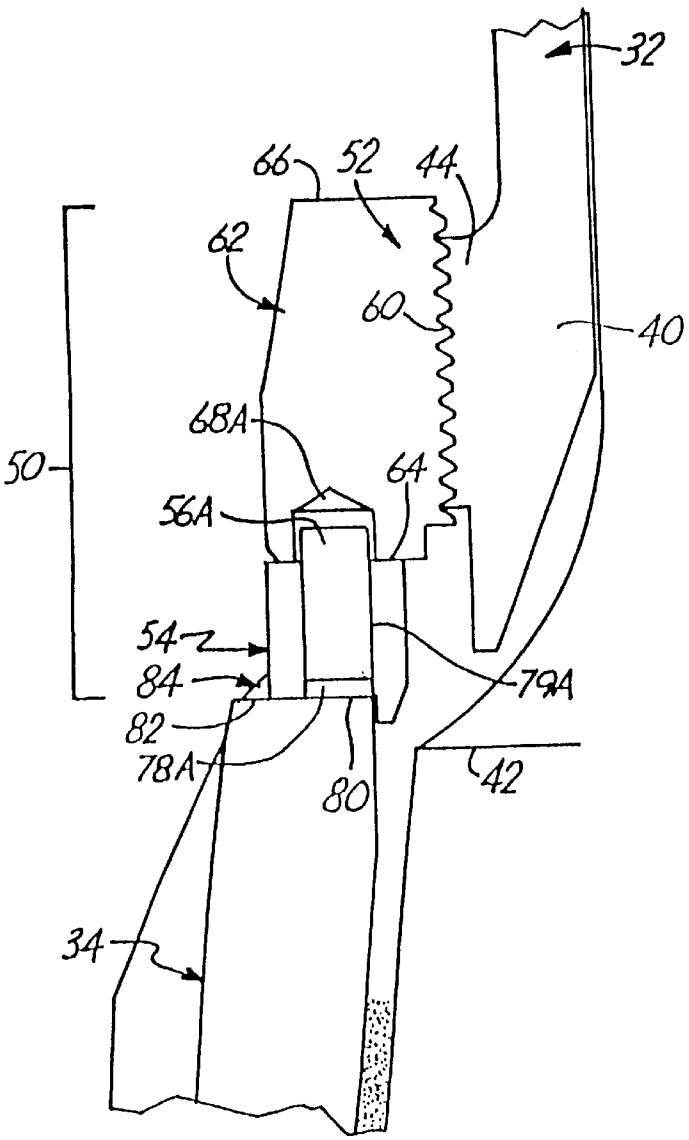

Bearing sleeve 32 extends coextensively with the upper journal portion 28 of the shaft 18, with its lower end 40 disposed proximate to the top end 42 of the tapered portion 26 of the shaft 18. As shown in FIG. 3, the lower end 40 of the bearing sleeve 32 includes an externally threaded annular shoulder 44. The threaded shoulder 44 is secured to the top end 42 of the mantle 34 through a head nut assembly 50.

The head nut assembly 50 includes an annular head nut 52, an annular burning ring 54 and keys 56A and 56B. The head nut 52 is internally threaded so as to be received by the threaded shoulder 44 of the bearing sleeve 32. Although the preferred embodiment of the invention threads the head nut 52 to the bearing sleeve 32, a person skilled in the art would realize that other embodiments conform to the spirit of the invention, including threading the head nut 52 directly to the upper journal portion 28 of the shaft 18. It is important to counter the rotational forces caused by the crushing action and maintain the mantle 34 in the same relative rotational position with the shaft 18. If this is not done, the mantle 34 can gouge the shaft 18, or break off the shaft 18 completely. The head nut 52 provides a downward force on the mantle 34 which forces the mantle 34 and filler 38 against the shaft 18, preventing the mantle 34 from rotating with respect to the shaft 18. Any rotational motion between the shaft 18 and the mantle 34 causes the nut 52 to tighten, adding additional downward force to the mantle 34 preventing further relative rotation.

Head nut 52 includes an internal threaded face 60 engaging the threaded bearing sleeve 32. An external face 62 is substantially parallel and coaxial to the threaded face 60. A lower face 64 is perpendicular and coaxial to the threaded face 60 extending between the threaded face 60 and the external face 62. An upper face 66 is parallel to the lower face 64 and perpendicular and coaxial to the threaded face 60, extending between the threaded face 60 and the external face 62. In one embodiment of the invention, the head nut 52 has an outer diameter of approximately twenty-nine inches, an inner diameter of approximately twenty-four inches and a height of approximately five inches. Head nut bores 68A and 68B extend perpendicularly into the lower face 64, and are disposed at diametrically opposite points of the lower face 62 (for example at noon and six o'clock as on the face of a clock). In one embodiment, each bore 68A and 68B has a diameter of approximately one inch and a depth of approximately three quarters of an inch.

Burning ring 54 includes a top face 70, an outer face 72, an inner face 74 and a bottom face 76. The top face 70 of the burning ring 54 contiguously engages the lower face 64 of the head nut 52. The bottom face 76 is parallel and coaxial to the top face 70 and includes a raised lip 77 which engages and centers the mantle 34 about the shaft 18. The outer face 72 is perpendicular and coaxial to the top face 70 and extends between the top face 70 and the bottom face 76. The inner face 74 is parallel to the outer face 72 and extends between the top face 70 and the bottom face 76. In one embodiment, the outer diameter of the burning ring 54 is approximately twenty-nine inches, and the inner diameter is approximately twenty-five inches. Burning ring bores (or apertures) 78A and 78B extend perpendicularly into top face 70 through the burning ring 54 and out the bottom face 76. Each burning ring bore 78A and 78B includes an inner wall 79A and 79B and is disposed directly below the head nut bores 68A and 68B respectively. Although dimensions have been provided for one embodiment of the inventive head nut assembly 50, a person skilled in the art would realize that dimensions will vary according to the size of the gyratory crusher 10.

The dowel shaped keys 56A and 56B are disposed in the burning ring bores 78A and 78B and extend upwardly into the head nut bores 68A and 68B. The keys 56A and 56B are typically welded into the burning ring bores 78A and 78B (preferably by fillet welding the bottom of each key 56A and 56B to the inner wall 79A and 79B of the burning ring bores 78A and 78B proximate to the bottom face 76 of the burning ring). Thus, the keys 56A and 56B are completely captured inside the head nut 52 and the burning ring 54, with no part of either key 56A and 56B exposed to the crushing chamber 36.

Capturing the keys 56A and 56B entirely within the head nut assembly 50 prevents the keys 56A and 56B from being subject to impingement of the crushing material. This prevents the keys 56A and 56B from being knocked out of bores 68A, 68B, 78A, and 78B which would allow the head nut 52 to rotate independently from the burning ring 54 causing the problems described above. Additionally, the use of the dowels 56A and 56B to key the head nut 52 to the burning ring 54 prevents the need to weld to the head nut 52. Welding to the head nut 52 can distort the head nut 52 requiring the head nut 52 to be cut off when it is to be removed, possibly damaging the threaded shoulder 44 of the bearing sleeve 32 in the process. Damage to the head nut 52 can thereby result in a great expense and associated downtime while the head nut 52, bearing sleeve 32 and possibly the shaft 18 are repaired.

The bottom face 76 of the burning ring 54 is generally contiguous with an upper surface 80 of the mantle 34. Mantle upper surface 80 is typically wider than the bottom face 76 of the burning ring 54 so as to form a shoulder 82 with the burning ring outer face 72. Preferably, a fillet weld 84 is used to attach the burning ring 54 to the mantle 34 along the shoulder 82. Welding the ring 54 to the mantle 34 connects the mantle 34 to the head nut assembly 50 during operation of the crusher 10. Since the burning ring 54 will be cut off during change out of the mantle 34, distortion due to welding is not a concern. Welding the burning ring 54 is a more reliable method of securing the ring 54 to the mantle 34 than using a keying method since it eliminates any possibility of keys coming loose and allowing the ring 54 to rotate relative to the mantle 34. Additionally, welding the ring 54 to the mantle 34 has the advantage of allowing the head nut assembly 50 to be tightened onto the mantle 34 without the necessity of aligning grooves or slots for keys. The head nut assembly 50 is fully torqued onto the mantle 34 and the ring 54 is fillet welded to the mantle 34. Although the preferred embodiment of the invention welds the mantle 34 to the burning ring 54, a person skilled in the art would realize that the mantle 34 can be keyed to the burning ring 54.

The inventive head nut assembly 50 has the additional advantage of being easily manufactured and installed in the crusher 10. The only machining required on the head nut 52 and the burning ring 54 for the keying system are the bores 68A, 68B, 78A and 78B which are easily machined using a drill-press. The dowels 56A and 56B do not need to be press fitted into the bores 68A, 68B, 78A and 78B in order to maintain a secure connection between the head nut 52 and the burning ring 54, since they can be welded to the inner walls 79A and 79B of the burning ring bores 78A and 78B. Thus, standard machining tolerances can be used.

Figure 4:
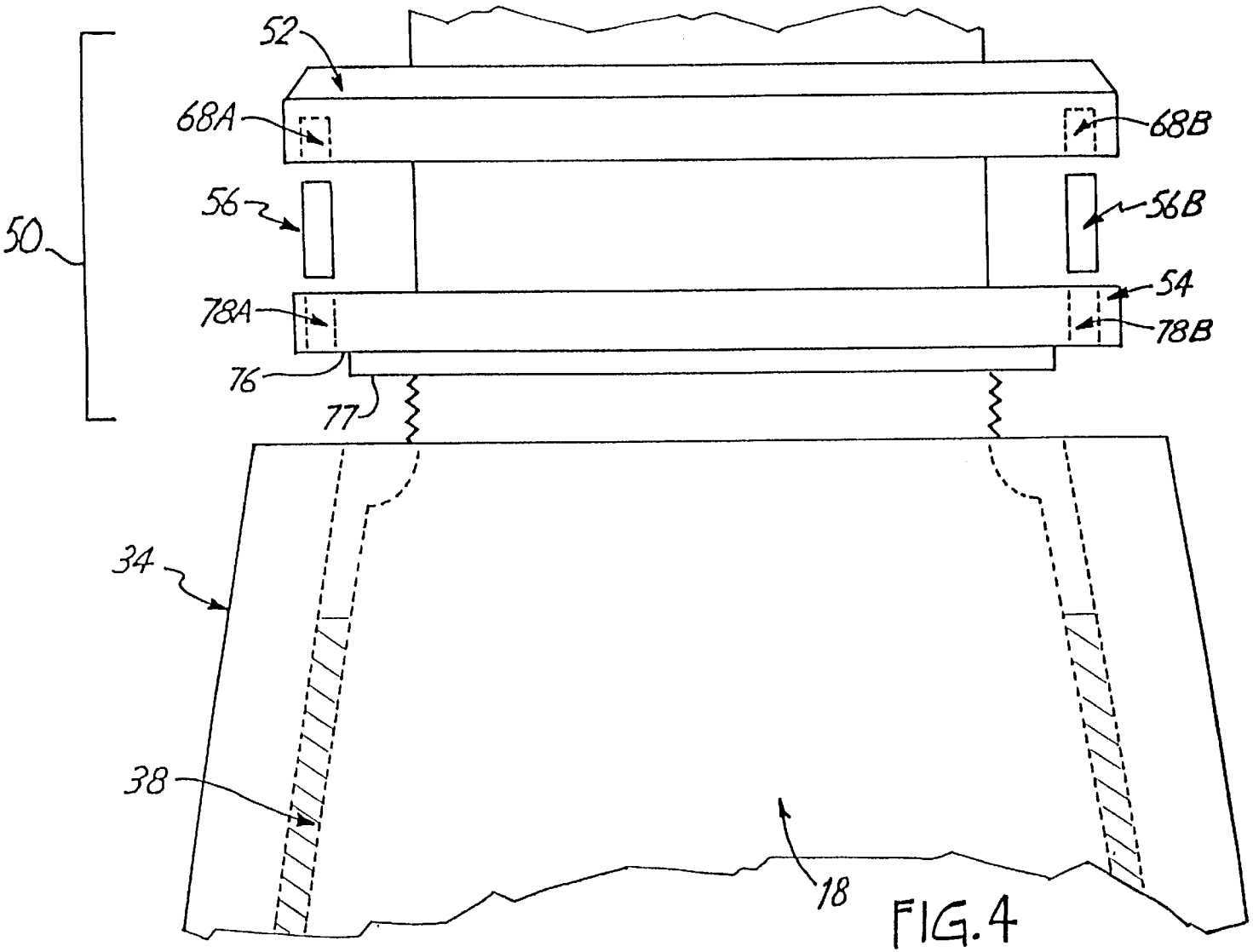
FIG. 4 shows an exploded partial view of the preferred embodiment of a gyratory crusher with the inventive head nut assembly.

The exploded view shown in FIG. 4 illustrates the method used to install the head nut assembly 50. The mantle 34 is set on the main shaft 18 and shimmed into position. The keys 56A and 56B are disposed into bores 68A, 68B, 78A and 78B. For convenience, the head nut 52 and the burning ring 54 can be lightly tack welded together (although this is not necessary). Tack welding the head nut 52 does not distort the nut 52 since heat is only applied to the nut 52 for a short amount of time. The keys 56A and 56B are fillet welded to the inner walls 79A and 79B of the burning ring bores 78A and 78B. The assembly of the head nut assembly may occur where it is manufactured (i.e. a burning ring assembly including the keys 56A and 56B welded in place and, if desired, the head nut 52 and burning ring 54 back welded together), limiting the amount of work that needs to be done at the crusher 10 site (eliminating crusher downtime). A person skilled in the art would realize, however, that the head nut assembly may take place at the crusher location.

The head nut assembly 50 is screwed onto the main shaft 18 until the raised lip 77 on the bottom face 76 of the burning ring 54 engages the inner diameter of the mantle 34. The lip 77 acts to center the mantle 34 about the main shaft 18 as the head nut assembly 50 is tightened onto the mantle 34. The backing material 38 is poured and allowed to harden and the burning ring 54 is fillet welded to the mantle 34.

When the mantle 34 is worn out and needs to be replaced, the burning ring 54 is cut horizontally (i.e. with a plasma torch), relieving pressure against the head nut 52 and allowing it to be unscrewed and re-used. The old mantle is removed and a new mantle is positioned about the shaft 18. The above process is then repeated using a new burning ring attached to the head nut 52 with new keys.

Figure 5:
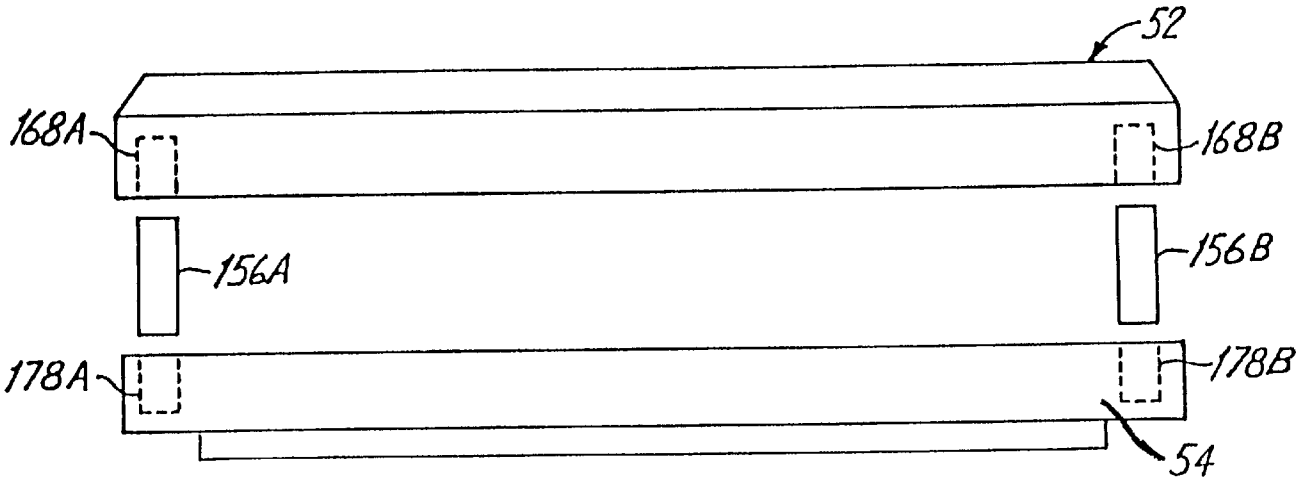
FIG. 5 shows an exploded side view of an alternate embodiment of the inventive head nut assembly.
Figure 5A:
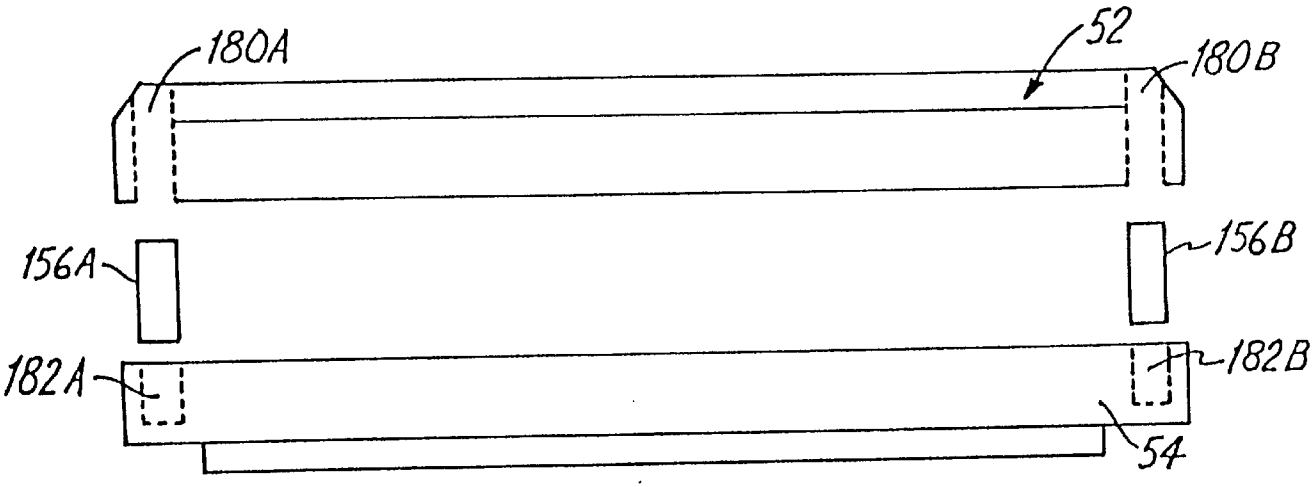
FIG. 5A shows an exploded side view of an alternate embodiment of the inventive head nut assembly.
Figure 5B:
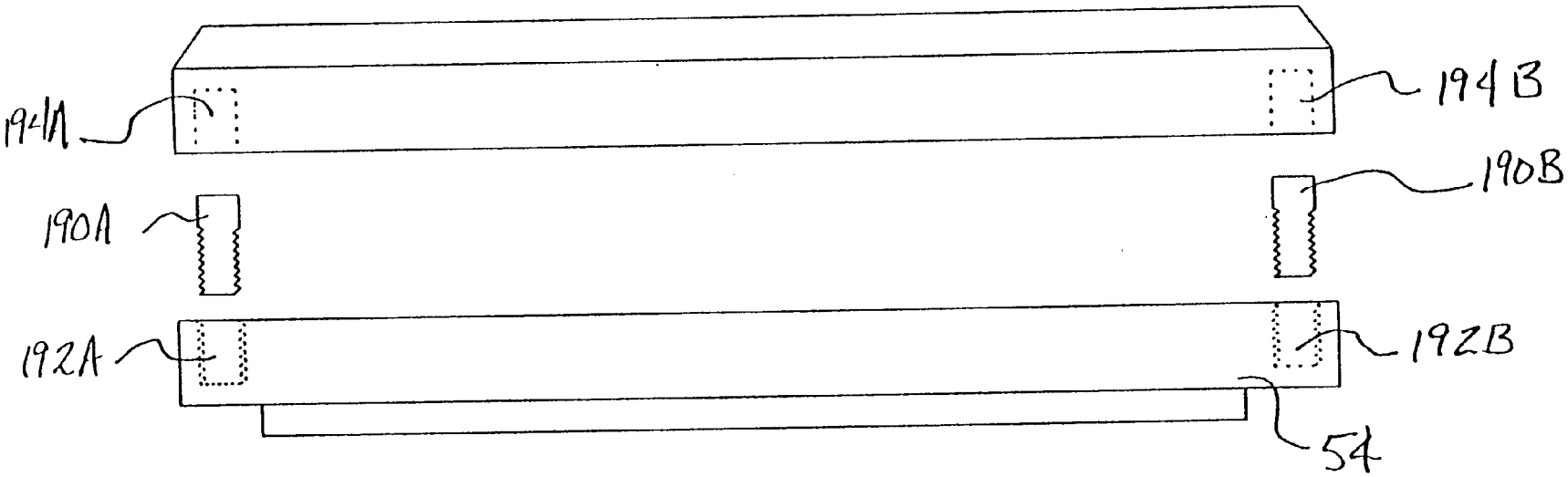
FIG. 5B shows an exploded side view of an alternate embodiment of the inventive head nut assembly.

The preferred embodiment of the invention secures the keys 56A and 56B into the burning ring 54 bores 78A and 78B by welding them to the inner wall 79A and 79B. Welding has the advantage of fixing the keys 56A and 56B into place, eliminating tipping of the keys 56A and 56B inside the bores 68A, 68B, 78A, and 78B. Tipping of the keys 56A and 56B causes greater shear forces on the keys 56A and 56B increasing the possibility of key breakage and separation of the nut 52 from the ring 54. An alternate embodiment of the invention would place keys 156A and 156B in blind bores 168A, 168B, 178A, and 178B drilled into the burning ring 54, as shown in FIG. 5. The keys 156A and 156B may be press fit into the bores 178A and 178B to eliminate tipping of the keys 156A and 156B. An additional alternative configuration would utilize head nut bores 180A and 180B which extend completely through the head nut 52, and blind burning ring bores 182A and 182B in the burning ring 54, as shown in FIG. 5A. The keys 156A and 156B are captured in bores 180A, 180B, 182A and 182B. The keys 156A and 156B are then fillet welded into the head nut bores 180A and 180B (once again, the short welding time to weld the two keys 156A and 156B to the head nut 52 does not cause head nut 52 distortion). Still another alternate embodiment is to insert threaded keys 190A and 190B into threaded burning ring bores 192A and 192B disposed in the burning ring 54 as shown in FIG. 5B. The threaded keys 190A and 190B eliminate tipping of the keys 190A and 190B in the burning ring bores 192A and 192B. The upper end of the keys 190A and 190B extend into blind head nut bores 194A and 194B, disposed in the head nut 52, locking the head nut 52 rotationally with respect to the burning ring 54.

Figure 6:
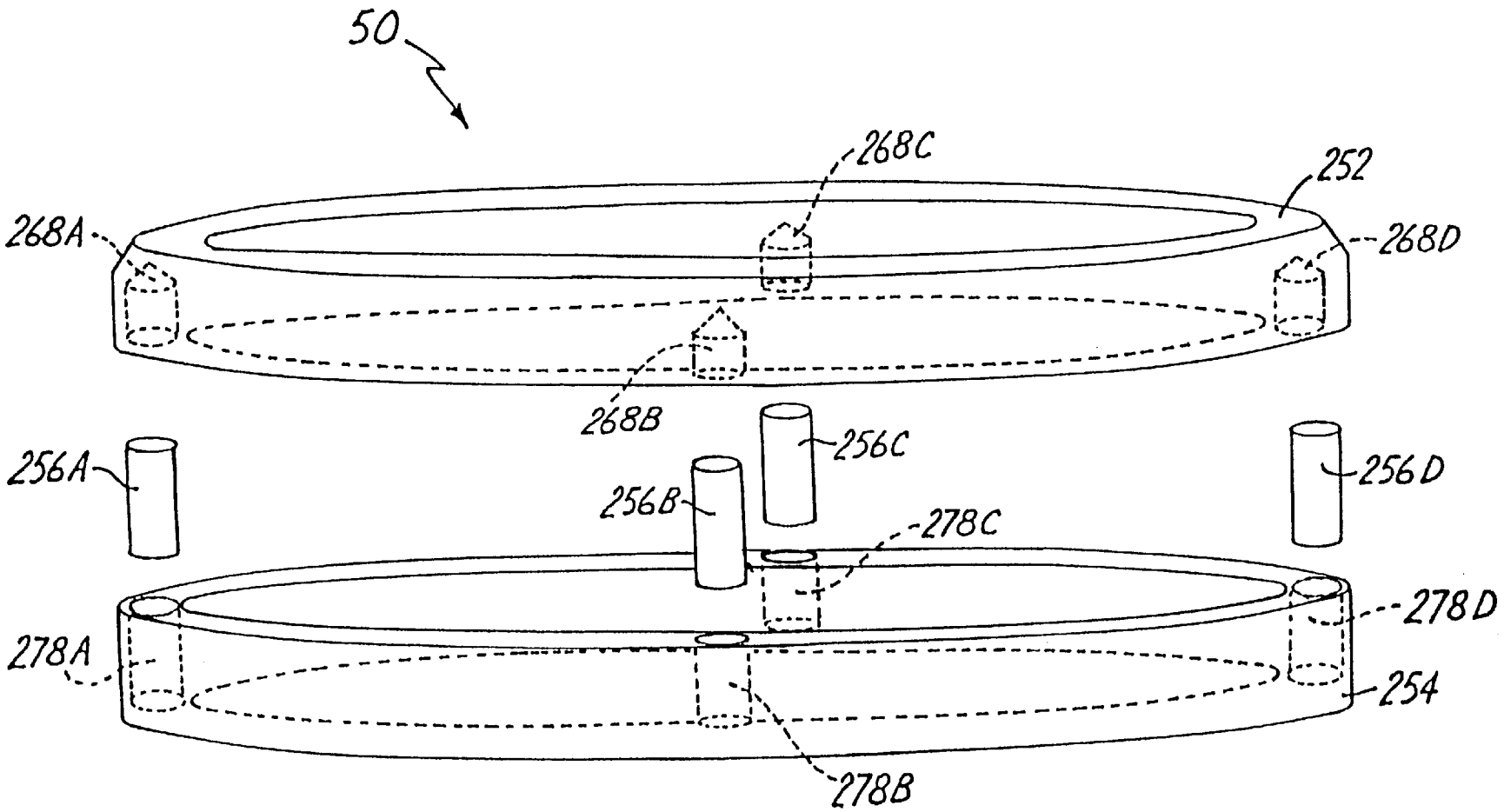
FIG. 6 shows an exploded perspective view of an alternate embodiment of the inventive head nut assembly.

Although the preferred embodiment uses two keys to connect the burning ring 54 to the head nut 52, a person skilled in the are would realized that additional keys may be used, as shown in FIG. 6. Keys 256A, 256B, 256C and 256D are positioned between burning ring bores 278A–278D and head nut bores 268A–268D so that the keys 256A–256D are not exposed to crushing material. Other key configurations utilizing additional keys spaced in various positions around the head nut assembly 50 may be used to secure the head nut 252 to the burning ring 254. Additionally, a person skilled in the art would realize that other key shapes may be utilized. For example, square, rectangular, or triangular pins may be used.

Figure 7:
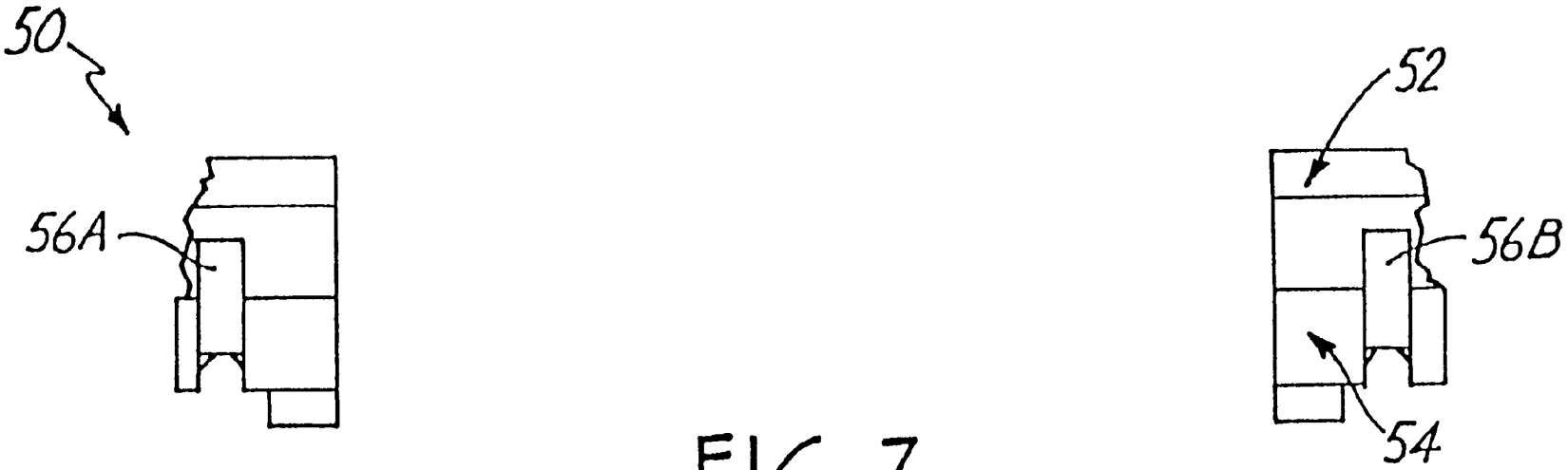
FIG. 7 is a cross sectional view of the head nut assembly shown after wearing due to the crushing process.

An additional advantage of the inventive head nut assembly 50 is the use of captured keys 56A and 56B inside the head nut 52 as an indication of head nut 52 wear. Although the head nut 52 does not wear as quickly as the mantle 34, eventually the head nut 52 does need to be replaced. An easy method for the operator to determine when this change-out needs to take place is when the keys 56A and 56B begin to show through the external face 62 of the head nut 52, as shown in FIG. 7.

The innovative method of positioning the keys 56A and 56B in a captured position between the head nut 52 and the burning ring 54 serves to maintain a reliable connection in the head nut assembly 50. Repair and down time costs are thereby substantially reduced, and maintenance is more easily scheduled and performed.

Although the present invention has been described with reference to preferred embodiments, workers skilled in the art will recognize that changes may be made in form and detail without departing from the spirit and scope of the invention.

What is claimed is:

1. A method for securing a mantle having a tapered internal side and an upper side, to a shaft having a lower portion, a middle portion correspondingly tapered to be in generally contiguous supportive engagement with the mantle internal side and a threaded upper portion of the shaft extending above the mantle, comprising:

disposing an annular ring around the shaft above the mantle;

threading a head nut to the upper portion of the shaft above the annular ring; and securing the head nut to the ring using a key totally captured inside the head nut and the annular ring.

2. The method of claim 1, further comprising:

welding the annular ring to the mantle.

3. The method of claim 1 wherein the head nut includes:

a lower face; and a bore extending upwardly into the lower face.

4. The method of claim 1 wherein the annular ring includes:

a top face;

a bottom face; and an aperture extending downwardly into the top face, through the annular ring, emerging from the bottom face, wherein a remaining portion of the key is captured inside the aperture.

5. The method of claim 4 wherein the key is welded into the aperture.

6. The method of claim 1 wherein the key is in the shape of a dowel.

7. A method for replacing a worn mantle disposed about a main shaft in a gyratory crusher comprising:

cutting through a used burning ring disposed annularly around the main shaft, unthreading a head nut disposed annularly about the main shaft and above the burning ring;

removing the worn mantle;

positioning a new mantle around the main shaft, wherein the mantle includes an upper side;

disposing a burning ring about the main shaft above the mantle including a lower surface and an upper surface, wherein an aperture extends perpendicularly into the upper surface, through the burning ring, and out the lower surface and a key is fixed into the aperture extending above the upper surface;

re-threading the head nut onto the main shaft above the burning ring, the head nut having a lower face and a bore extending perpendicularly into the lower face;

securing the burning ring to the head nut by positioning the portion of the key extending above the upper surface into the bore in the head nut; and fixing the burning ring to the mantle.

* * * * *